US006709352B1

(12) United States Patent
Albin

(10) Patent No.: US 6,709,352 B1
(45) Date of Patent: Mar. 23, 2004

(54) METAL BASE BALL BAT

(76) Inventor: Joel N. Albin, 29881 S. Red Oak Rd., Livingston, LA (US) 70754

( * ) Notice: Subject to any disclaimer, the term of this patent is extended or adjusted under 35 U.S.C. 154(b) by 0 days.

(21) Appl. No.: 09/990,986

(22) Filed: Nov. 14, 2001

(51) Int. Cl.[7] ..... A63B 59/06
(52) U.S. Cl. ..... 473/520; 473/566
(58) Field of Search ..... 473/564–568, 473/519, 520

(56) References Cited

U.S. PATENT DOCUMENTS

| | | | | | |
|---|---|---|---|---|---|
| 5,180,163 | A | * | 1/1993 | Lanctot et al. | 473/520 |
| 5,362,046 | A | | 11/1994 | Sims | 273/73 R |
| 5,380,003 | A | * | 1/1995 | Lanctot | 473/520 |
| 5,655,980 | A | * | 8/1997 | Nashif et al. | 473/520 |
| 5,692,971 | A | | 12/1997 | Williams | 473/318 |
| 5,759,113 | A | * | 6/1998 | Lai et al. | 473/321 |
| 5,772,541 | A | | 6/1998 | Buiatti | 473/520 |
| 5,937,843 | A | | 8/1999 | Troncoso | 124/89 |
| 5,944,617 | A | * | 8/1999 | Falone et al. | 473/300 |
| 5,964,672 | A | * | 10/1999 | Bianchi | 473/521 |
| 6,007,439 | A | | 12/1999 | MacKay, Jr. | 473/520 |
| 6,042,485 | A | * | 3/2000 | Cheng | 473/318 |
| 6,077,178 | A | * | 6/2000 | Brandt | 473/520 |
| 6,117,028 | A | * | 9/2000 | You | 473/520 |
| 6,257,220 | B1 | | 7/2001 | McPherson et al. | 124/89 |

OTHER PUBLICATIONS

Mathews Solocam Catch Us if You Can Catalog; pp. 7–13; Mathews Archery; 919 River Road, P.O. Box 367, Sparta Wisconsin 54656 No Publication Date Available. Commercialization of device claimed in U.S. Patent 6,257,220 issued: Jul. 10, 2001.

* cited by examiner

*Primary Examiner*—Mark S. Graham
(74) *Attorney, Agent, or Firm*—Russel O. Primeaux; Kean, Miller, Hawthorne, D'Armond, McGowan & Jarman L.L.P.

(57) ABSTRACT

An improved tubular metal base ball bat that includes a damping device having a mass suspended by a number of resilient supports that is mechanically coupled to the hand gripping end of the bat.

6 Claims, 7 Drawing Sheets

METAL BASE BALL BAT

TECHNICAL FIELD

The present invention relates to metal base ball bats and more particularly to an improved metal baseball bat having a tubular outer metal shell portion that tapers from a tubular ball striking end down to a tubular hand gripping end and that includes a vibration damping mechanism coupled to the tubular outer metal shell portion for rapidly damping vibrations caused in the tubular outer metal shell portion by the impact between the ball striking end of the tubular metal shell portion and a baseball; the vibration damping mechanism being mechanically coupled to the tubular hand gripping end of the tubular outer metal shell portion around an entire hand gripping end circumference thereof and including a damping mass supported by a resilient surrounding support structure formed from a number of resilient mass supports extending between a resilient outer attachment ring and an inner damping mass holding ring; the inner damping mass holding ring being within the resilient outer attachment ring; the resilient outer attachment ring having an outer ring attachment circumference mechanically coupled to the entire hand gripping end circumference such that vibrations travel from the entire hand gripping end circumference to the outer ring attachment circumference.

BACKGROUND ART

Metal base ball bats have become popular because of the increased durability of the metal bats. These metal base ball bats are constructed from a metal tube that has a large diameter at the ball striking end and tapers down to a narrow diameter at the user hand grip end. The ends of the metal tube are closed by a variety of mechanisms. Although metal base ball bats have increased durability over wooden base ball bats, metal base ball bats can develop severe vibrations after striking a baseball that are so severe that many individuals develop hand and wrist injuries. These injuries are the result of the user's hands and wrists absorbing the vibrational forces of the metal bat from the vibrating hand grip end of the metal bat as they swing the bat and strike a baseball. Applicant believes the severity of the vibrational forces results from the vibrations being transferred along a tube that decreases in diameter. As the vibrations move down form the larger diameter ball striking end toward the much smaller diameter hand gripping end, the frequency of the vibrations increases. It is these high frequency vibrations which cause the stinging felt by ball players when using these metal bats. Because these severe vibrations are such a problem, many attempts have been made to lessen or remove the vibrations.

U.S. Pat. No. 5,362,046 to Sims shows a vibration damping device for reducing the vibrations of a baseball bat that is formed from resilient material coupled to the inner wall of the hand grip end a tubular metal bat (see FIGS. 3 and 4).

U.S. Pat. No. 5,772,541 to Buiatti shows a tubular metal bat that has a donut shaped elastomeric member 40 connected to the outer wall of the hand grip end of a tubular metal bat (see FIGS. 1*a* and 4); a disk shaped elastomeric member connected to the end of the hand grip end of a tubular metal bat (see FIG. 3); and a cylinder-shaped elastomeric member inserted within the tubular cavity at the cap end of the hand grip end of a tubular metal bat (See FIG. 6).

U.S. Pat. No. 6,007,439 to McKay, Jr. discloses a vibration dampener for metal ball bats that discloses a resilient foam-like dampener that has a stem 44 inserted into the open end of the hand grip end of a tubular metal.

Each of the above patents discloses a damping mechanism that is formed substantially entirely from a resilient material and work to one degree or another but have not worked sufficiently well to become accepted by bat manufacturers.

Each of the patents describes a tubular metal bat with a completely resilient dampening mechanism coupled to the hand grip end of the tubular metal bat in one manner or another, however, none of these bats has provided an effective reduction in the severity of the tubular vibrations which make tubular metal bats so dangerous and uncomfortable to use.

Applicant has discovered that the high frequency vibrations generated in the hand grip end of a metal tubular bat require a different type of damping mechanism than the mechanism heretofore employed. The damping mechanism required to drastically minimize or eliminate the severe standing type tubular vibrations that cause pain and injuries to ball players cannot utilize thick sections of resilient material as used in each of the above attempts but requires a damping mechanism which reacts to and rapidly damps high frequency vibrations by the use of a damping mass supported by resilient supports coupled to the tubular hand grip end of a tubular metal base ball bat in the proper manner. Applicant has added such damping mechanisms to tubular metal bats and achieved, in some cases, such drastic reductions in the vibrations heretofore described as to virtually eliminate the vibrations felt by a user. An exemplary damping mechanism, of the type found by Applicant to be effective in reducing and/or eliminating the vibrations under discussion, is disclosed in U.S. Pat. No. 6,257,220 to McPherson et al. The Bow Handle Damper" of McPherson discloses an archery bow damping device that is designed to dampen the high frequency reciprocating vibrations that are produced in the solid handle and solid bow limbs of a compound archer bow when the bow string is released and an arrow is rapidly driven away from the bow. The high frequency reciprocating vibrations that are produced in the solid materials of the handle and limbs of the compound bow caused by the release of an arrow are completely mechanically different in vibrational wave characteristics than the tubular vibrations generated in a tubular base ball bat having a larger diameter ball striking end that tapers down in diameter to a smaller tubular hand gripping end caused by a rapidly moving ball striking end of the metal bat tube striking a baseball traveling at a velocity of up to a hundred miles an hour in the opposite direction. Tubular vibrations cause the metal tube of the metal, tubular base ball bat to rapidly contract and expand in diameter during vibrations while reciprocating vibrations in a solid material cause the vibrating solid material to move back and forth like the tine of a tuning fork or a guitar string and would presumable each require damping mechanisms having different characteristics. Applicant has discovered that by properly coupling a damping mechanism such as the one shown for use in the "Bow Handle Damper" patent of McPherson, that vibrations at the hand gripping end of a tubular base ball bat are eliminated or are so attenuated as to be virtually undetectable by a user of such a bat. This is a surprising result as the damping mechanism of McPherson is designed to dampen vibrations that move in two directions simultaneously with respect to the mass, i.e. one side of the vibrating solid bow part is moving toward the mass while the other side of the bow is moving away from the mass during each half cycle of the vibrational wave. In the tubular wave of the metal, tubular base ball bat, the metal base ball bat tube is pushing in toward the mass from all directions during one half of the wave and away from the mass during the second half of the wave cycle. This is a completely different wave dynamic and unexpectedly provides a remarkable result far in excess of what is achieved by the damping devices of the above discussed patents.

GENERAL SUMMARY OF DISCUSSION OF INVENTION

It is thus an object of the inventien to provide an improved metal baseball bat having a tubular outer metal shell portion that tapers from a tubular ball striking end down to a tubular hand gripping end and that includes a vibration damping mechanism coupled to the tubular outer metal shell portion for rapidly damping vibrations caused in the tubular outer metal shell portion by the impact between the ball striking end of the tubular metal shell portion and a baseball; the vibration damping mechanism being mechanically coupled to the tubular hand gripping end of the tubular outer metal shell portion around an entire hand gripping end circumference thereof and including a damping mass supported by a resilient surrounding support structure formed from a number of resilient mass supports extending between a resilient outer attachment ring and an inner damping mass holding ring; the inner damping mass holding ring being within the resilient outer attachment ring; the resilient outer attachment ring having an outer ring attachment circumference mechanically coupled to the entire hand gripping end circumference such that vibrations travel from the entire hand gripping end circumference to the outer ring attachment circumference.

It is a further object to provide an improved metal base ball bat as previously described wherein the outer ring attachment circumference of the resilient outer attachment ring is directly mechanically coupled to the entire hand gripping end circumference by direct connection with an interior circumferential surface of the tubular hand gripping end.

It is a further object to provide an improved metal base ball at as previously described wherein the outer ring attachment circumference of the resilient outer attachment ring is directly mechanically coupled to an attachment fixture having a plug end inserted into and in direct contact with an interior circumferential surface of the tubular hand gripping end and a thin-walled, resonating ring end at least partially forming a vibration damping mechanism receiving cavity within which the vibration damping mechanism is positioned in a manner such that at least a portion of the outer ring attachment circumference of the resilient outer attachment ring is directly mechanically connected to an inner wall surface of the thin-walled, resonating ring; the thin-walled, resonating ring being in direct mechanical connection with the plug end of the attachment fixture in a manner such that vibrational forces generated in the tubular outer metal shell portion of the metal base ball bat are transferred between the tubular hand gripping end and the vibration damping mechanism through the thin-walled, resonating ring of the attachment fixture.

Accordingly, an improved metal baseball bat is provided. The an improved metal baseball bat includes a tubular outer metal shell portion that tapers from a tubular ball striking end down to a tubular hand gripping end and that includes a vibration damping mechanism coupled to the tubular outer metal shell portion for rapidly damping vibrations caused in the tubular outer metal shell portion by the impact between the ball striking end of the tubular metal shell portion and a baseball; the vibration damping mechanism being mechanically coupled to the tubular hand gripping end of the tubular outer metal shell portion around an entire hand gripping end circumference thereof and including a damping mass supported by a resilient surrounding support structure formed from a number of resilient mass supports extending between a resilient outer attachment ring and an inner damping mass holding ring; the inner damping mass holding ring being within the resilient outer attachment ring; the resilient outer attachment ring having an outer ring attachment circumference mechanically coupled to the entire hand gripping end circumference such that vibrations travel from the entire hand gripping end circumference to the outer ring attachment circumference.

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
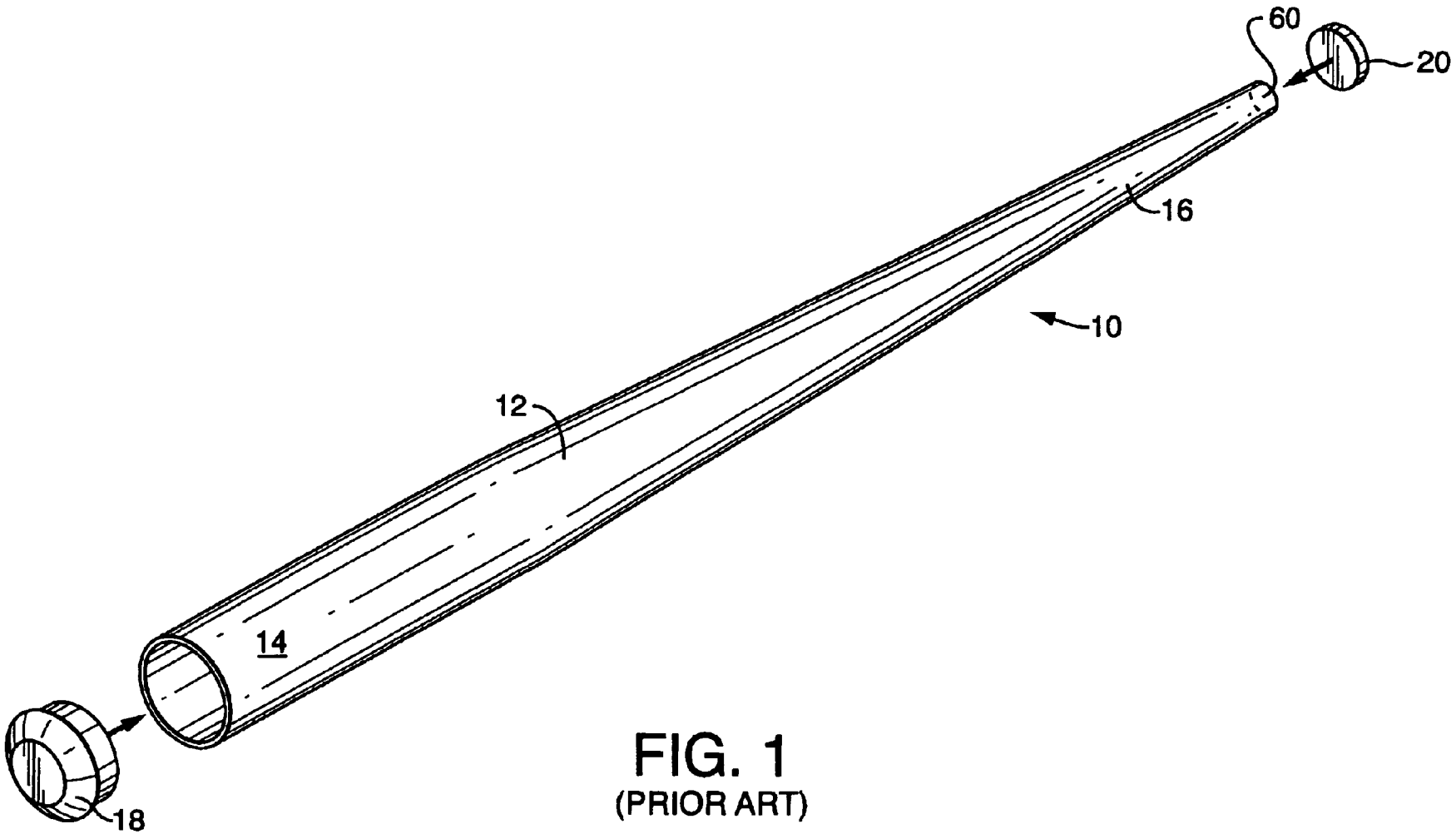
FIG. 1 (PRIOR ART)
FIG. 1 is an exploded perspective view of a representative metal baseball bat showing a tubular outer metal shell portion that tapers from a tubular ball striking end down to a tubular hand gripping end, a ball striking end cap structure, and a hand gripping end cap structure.
Figure 2:
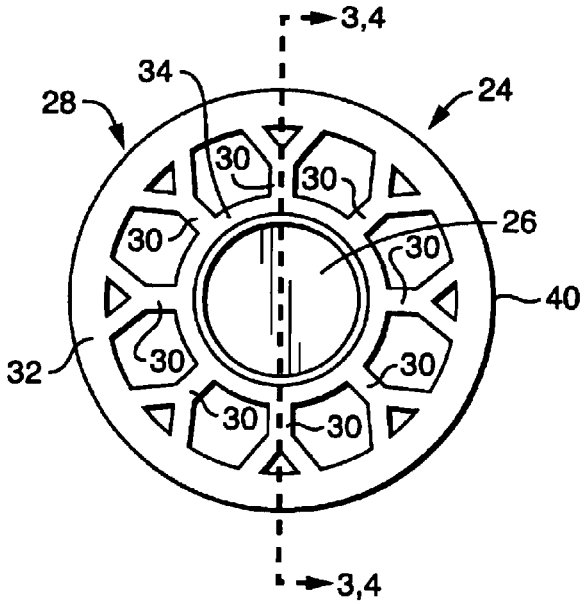
FIG. 2 is a top plan view of a first exemplary embodiment of a vibration damping mechanism of the improved metal baseball bat of the present invention showing a cylinder-shaped damping mass supported by a resilient surrounding support structure formed from a number of resilient Y-shaped mass supports extending between a resilient outer attachment ring and an inner damping mass holding ring.
Figure 3:
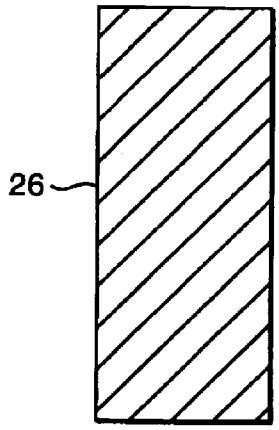
FIG. 3 is cross sectional view through the cylinder-shaped damping mass of the vibration damping mechanism of FIG. 2 along the line 3,4—3,4.
Figure 4:
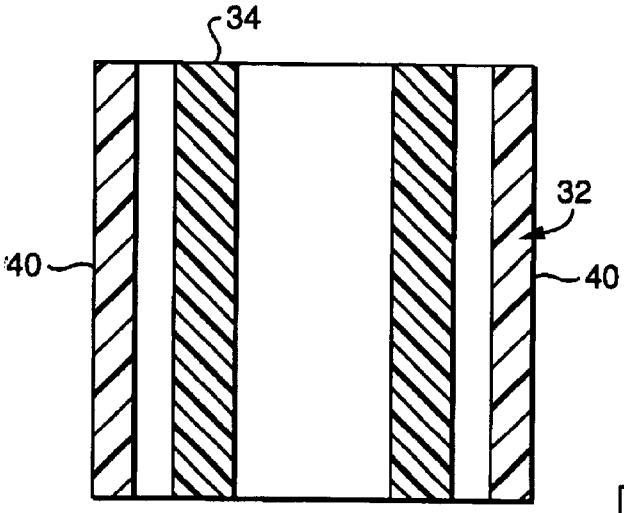
FIG. 4 is a cross sectional view of the resilient surrounding support structure of the damping mechanism of FIG. 2 with the damping mass removed and showing the resilient outer attachment ring, the inner damping mass holding ring, and two of the resilient Y-shaped mass supports extending between the resilient outer attachment ring and the inner damping mass holding ring.
Figure 5:
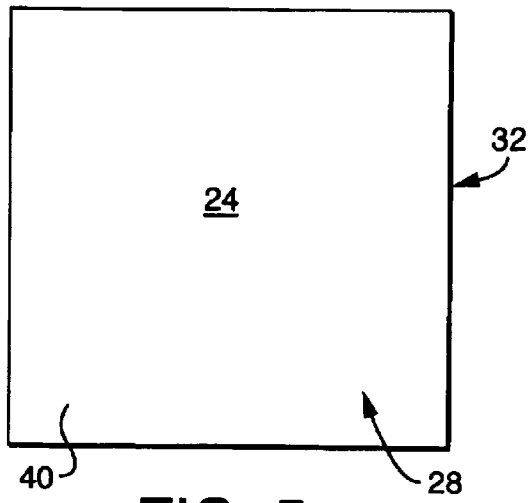
FIG. 5 is a side plan view of the vibration damping mechanism of FIG. 2 showing the exterior of the resilient outer attachment ring.
Figure 6:
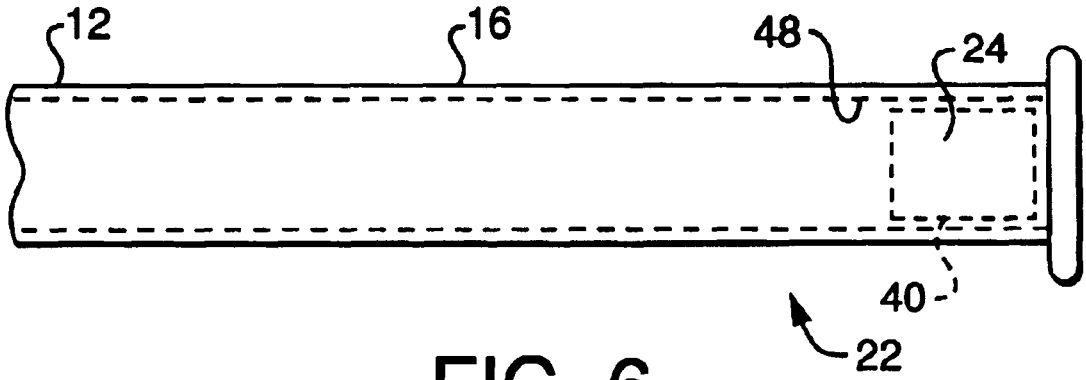
FIG. 6 is a partial side view of a first exemplary embodiment of the improved metal baseball bat of the present invention showing the vibration damping mechanism of FIG. 2 (shown in dashed lines) installed within the tubular hand gripping end such that the exterior of the resilient outer attachment ring is in mechanical contact with the inner surface of the tubular hand gripping end.
Figure 7:
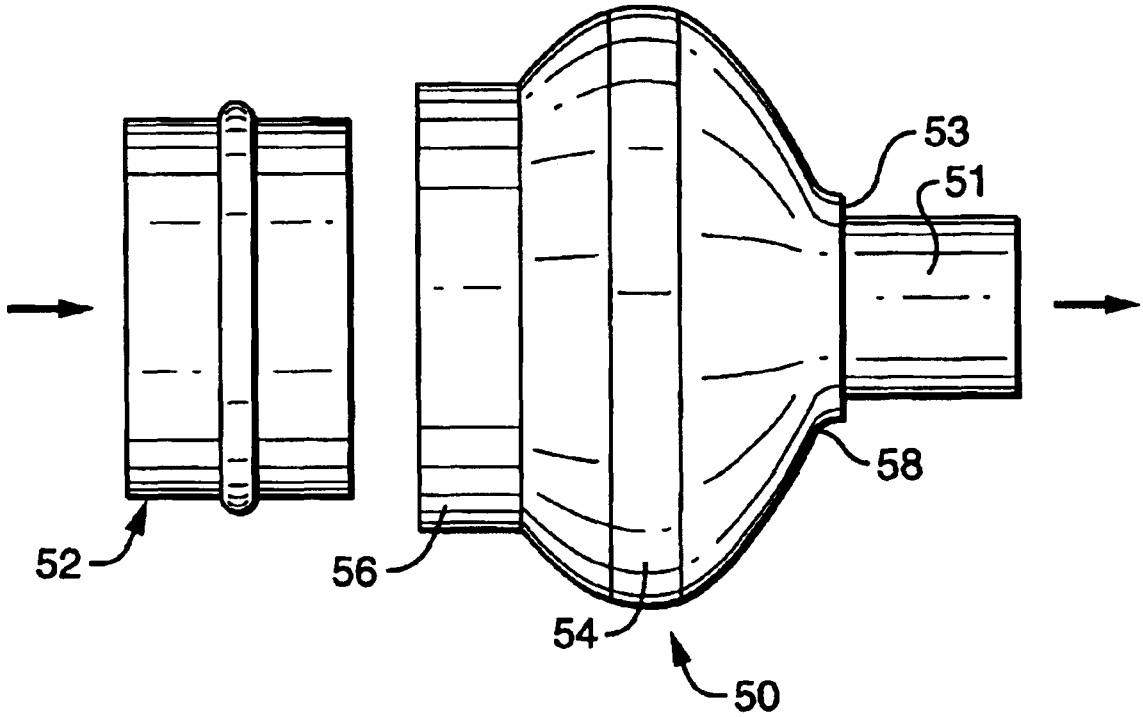
FIG. 7 is an exploded perspective view of a second exemplary damping mechanism that utilizes an attachment fixture having a plug end and a thin-walled, resonating ring end at least partially forming a vibration damping mechanism receiving cavity within which the vibration damping mechanism is positioned.
Figure 8:
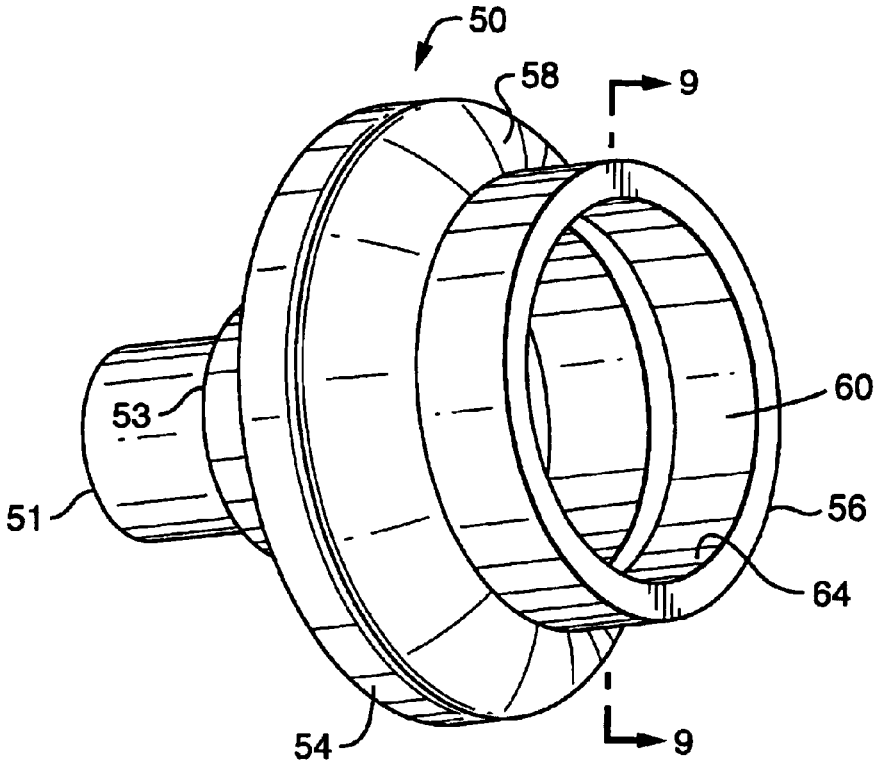
FIG. 8 is a perspective view of the attachment fixture in isolation.
Figure 9:
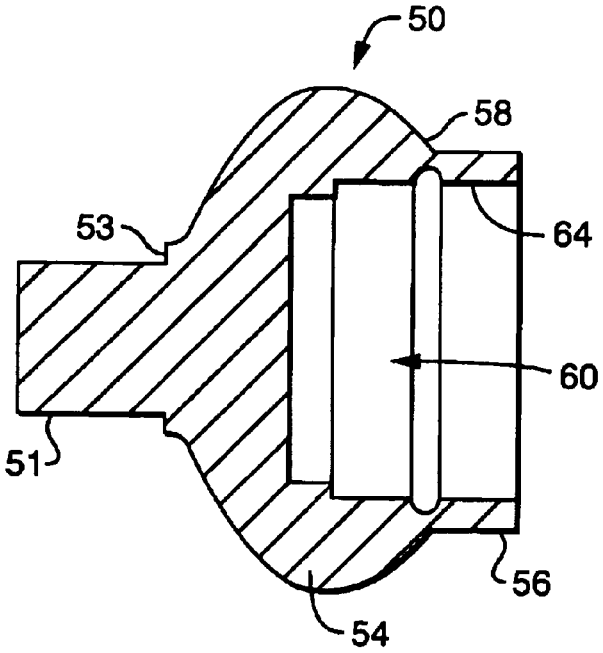
FIG. 9 is a sectional view through the attachment fixture of FIG. 8.
Figure 10:
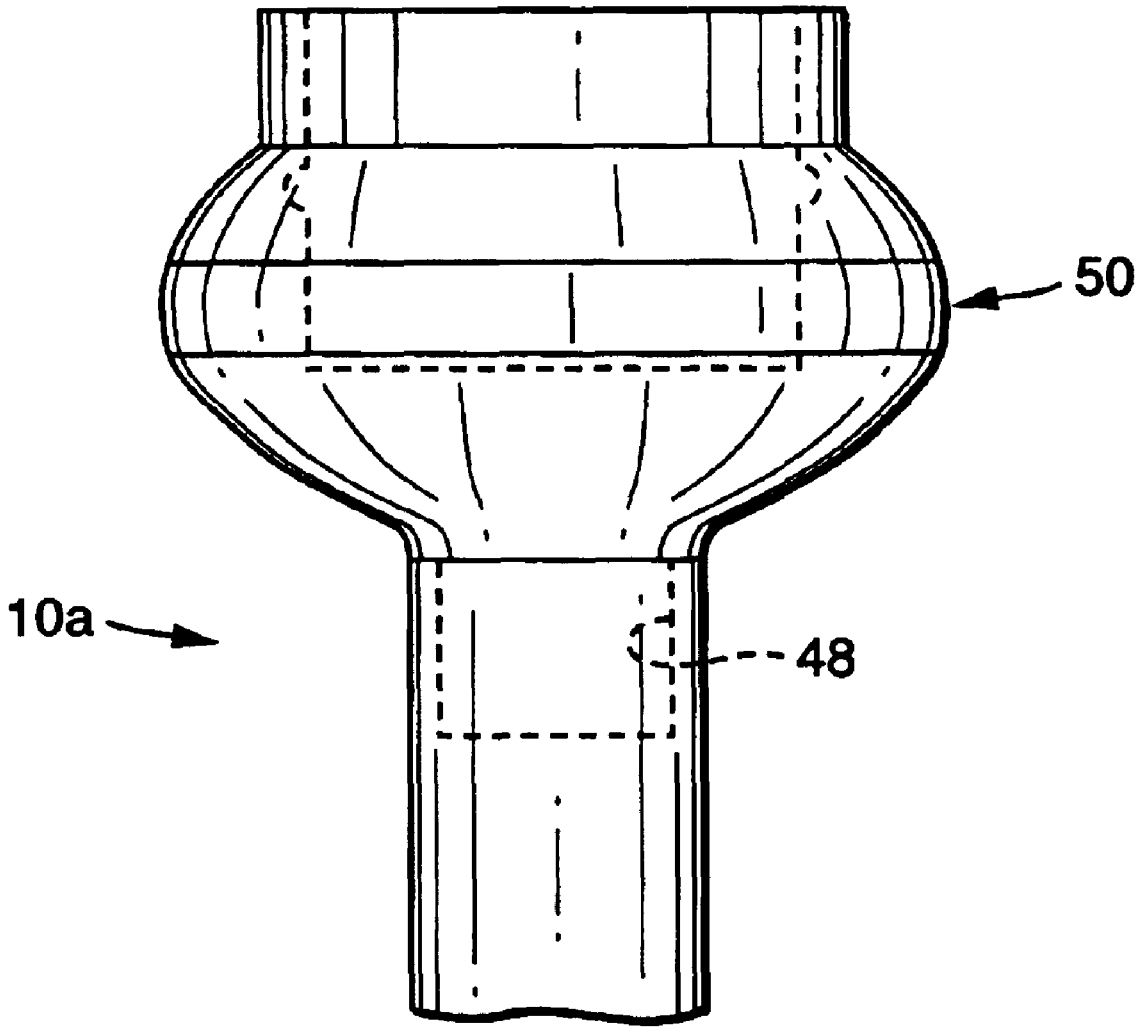
FIG. 10 is side plan view of a second exemplary improved metal baseball bat of the present invention showing the plug end of the attachment fixture installed in direct contact with an interior circumferential surface of the tubular hand gripping end of the tubular outer metal shell portion.
Figure 11:
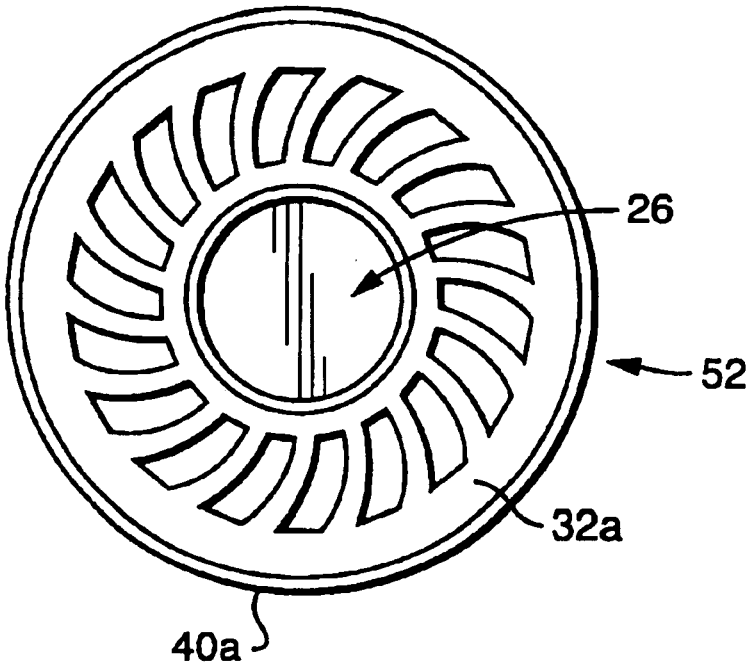
FIG. 11 is a top plan view of the second exemplary damping mechanism shown in FIG. 7 showing a circumferential, outwardly extending retaining ring on the exterior of the resilient outer attachment ring thereof and a number of curved resilient mass supports extending between the resilient outer attachment ring and the inner damping mass holding ring.
Figure 12:
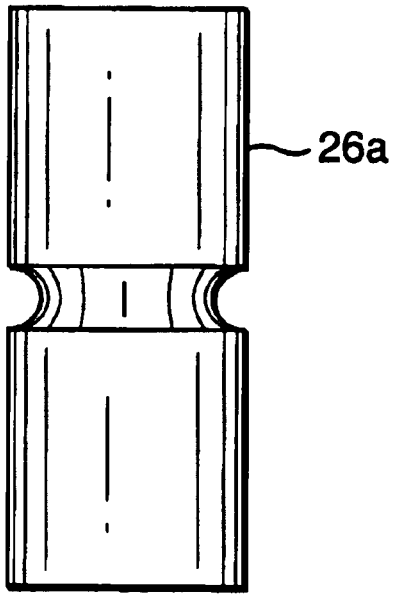
FIG. 12 is a side plan view of substantially cylinder-shaped inner damping mass of the second exemplary damping mechanism showing a circumferential, mass retaining groove provided therein for receiving a circumferential mass retain structure extending from the inner mass facing surface of the inner damping mass holding ring.
Figure 13:
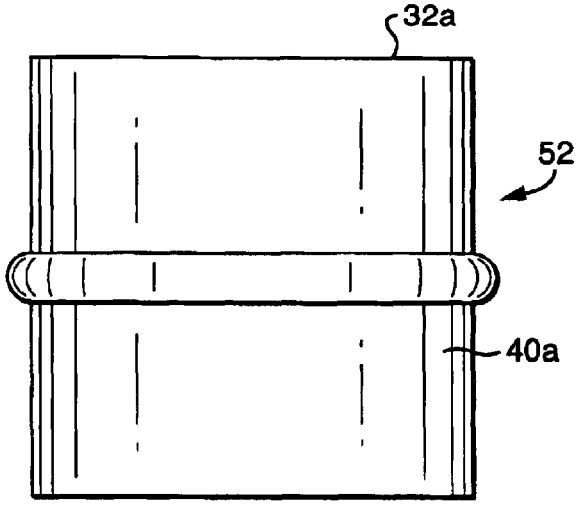
FIG. 13 is a side plan view of the second exemplary damping mechanism showing a circumferential, outwardly extending retaining ring on the exterior of the resilient outer attachment ring thereof.
Figure 14:
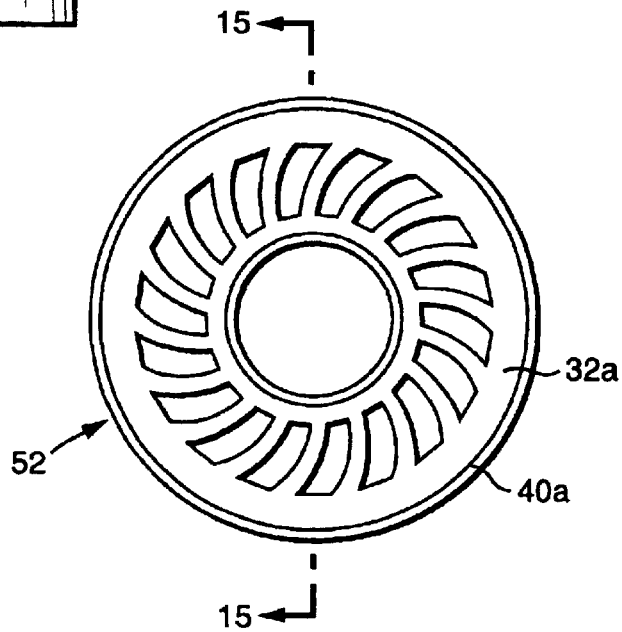
FIG. 14 is a sectional view through the view of the improved metal baseball bat
Figure 15:
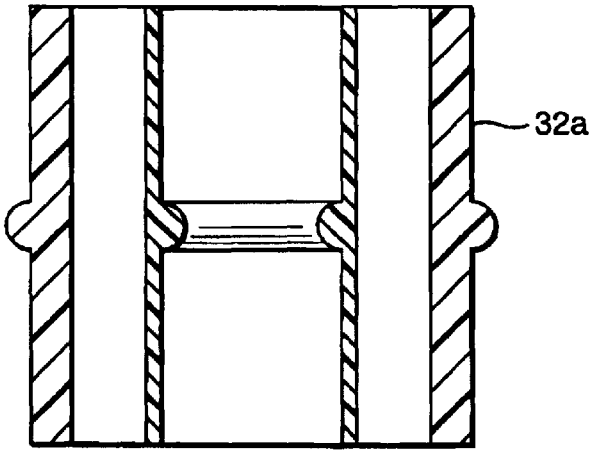
FIG. 15 is a sectional view of the resilient surrounding support structure of the damping mechanism of FIG. 11 with the inner damping mass removed and showing the circumferential mass retain structure extending from the surface of the inner damping mass holding ring.

FIG. 1 shows a representative prior art metal, tubular base ball bat generally designated 10 having a tubular outer metal shell portion, generally designated 12, that tapers from a tubular ball striking end, generally designated 14, down to a tubular hand gripping end, generally designated 16. Tubular ball striking end 14 is capped by a ball striking end cap structure 18 and tubular hand gripping end 16 is capped by a hand gripping end cap structure 20.

FIGS. 2–6 show various aspects of a first exemplary embodiment of the improved metal base ball bat of the present invention, generally designated 22. Improved metal base ball bat 22 includes a vibration damping mechanism, generally designated 24, (shown in dashed lines in FIG. 6) coupled to the tubular outer metal shell portion 12 for rapidly damping vibrations caused in the tubular outer metal shell portion by the impact between the ball striking end of the tubular metal shell portion 14 and a baseball. Vibration damping mechanism 24 is mechanically coupled to tubular hand gripping end 16 of tubular outer metal shell portion 12 around an entire hand gripping end circumference thereof and includes a damping mass, generally designated 26, supported by a resilient surrounding support structure, generally designated 28, formed from a number of resilient, Y-shaped mass supports 30 extending between a resilient outer attachment ring, generally designated 32, and an inner damping mass holding ring, generally designated 34. Inner damping mass holding ring 34 is held within resilient outer attachment ring 32 by mass supports 30.

In this embodiment, resilient outer attachment ring 32 has an outer ring attachment circumference 40 mechanically coupled to an entire hand gripping end circumference inner surface 48 such that vibrations are coupled from hand gripping end circumference 48 to outer ring attachment circumference 40. It is believed that the deformations of the mass supports 30 dissipate the vibrational energy almost instantaneously.

FIGS. 7–15 illustrate various aspects of a second exemplary embodiment of the improved metal base ball bat of the present invention generally designated 10*a*. In this embodiment, hand gripping end cap structure 20 of base ball bat 10 is replaced by an attachment fixture, generally designated 50. In this embodiment, a second exemplary damping mechanism, generally designated 52, includes a mass 26a and is coupled to tubular hand gripping end 16 by attachment fixture 50.

Attachment fixture 50 is formed from aluminum and includes a plug end 51 extending from bat facing side 53 of a fixture body portion, generally designated 54, and a thin-walled resonating ring, generally designated 56, extending from an opposite side 58 of fixture body portion 54. Plug end 51 is sized such that when it is inserted into an open end 60 of tubular hand gripping end 16 it frictionally contacts interior circumferential surface 48 of tubular hand gripping end 16.

Thin-walled, resonating ring 56 and fixture body portion 54 together define a vibration damping mechanism receiving cavity, generally designated 60 within which vibration damping mechanism 52 is positioned in a manner such that at least a portion of the outer ring attachment circumference 40*a* of the resilient outer attachment ring 32*a* is directly mechanically connected to an inner wall surface 64 of the thin-walled, resonating ring 56. Applicant believes, use of thin-walled, resonating ring 56 increases the vibrational transfer as the vibrations travel from hand grip end 16 though body portion 54 and then into thin-walled resonating ring 56 where the vibrational energy is free to vibrate thin-walled, resonating ring 56 which then transfers the energy into the resilient mass supports 30*a* where it is rapidly dissipated.

It can be seen from the preceding description that an improved metal baseball bat has been provided.

It is noted that the embodiment of the improved metal baseball bat described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A metal baseball bat comprising:

(a) a tubular outer metal shell portion that tapers from a tubular ball striking end down to a tubular hand gripping end;

(b) a vibration damping mechanism coupled to the tubular outer metal shell portion for rapidly damping vibrations caused in the tubular outer metal shell portion by the impact between the ball striking end of the tubular metal shell portion and a baseball;

(c) the vibration damping mechanism being mechanically coupled to the tubular hand gripping end of the tubular outer metal shell portion around a hand gripping end circumference thereof and including a damping mass supported by a resilient surrounding support structure formed from a number of resilient mass supports extending between a resilient outer attachment ring and an inner damping mass holding ring;

(d) the inner damping mass holding ring being within the resilient outer attachment ring;

(e) the resilient outer attachment ring having an outer ring attachment circumference mechanically coupled to the hand gripping end circumference such that vibrations travel from the hand gripping end circumference to the outer ring attachment circumference; and (e) each of said resilient mass supports having at least some portion that is not radially oriented with respect to the radii of said outer attachment ring.

2. The improved metal baseball bat of claim 1 wherein:

the outer ring attachment circumference of the resilient outer attachment ring is directly mechanically coupled to the hand gripping end circumference by direct connection with an interior circumferential surface of the tubular gripping end.

3. The bat of claim 1, wherein said mass supports are Y-shaped.

4. The bat of claim 1, wherein said mass supports are substantially shaped like an arc having an open side and a closed side, each said open side of each support facing the closed side of an adjacent support.

5. A metal baseball bat comprising:

(a) a tubular outer metal shell portion that tapers from a tubular ball striking end down to a tubular hand gripping end;

(b) an attachment fixture having:

(i) a plug end inserted into and in direct contact with an interior circumferential surface of said tubular hand gripping end; and (ii) a resonating ring end at least partially forming a vibration damping mechanism receiving cavity, said resonating ring end having an inner wall surface;

(c) a vibration damping mechanism comprising:

(i) a damping mass supported by a resilient surrounding support structure formed from a number of resilient mass supports extending between a resilient outer attachment ring and an inner damping mass holding ring; and (ii) said inner damping mass holding ring being within the resilient outer attachment ring;

(d) said outer attachment ring being coupled to said inner wall surface of said resonating ring; and (e) said resonating ring being in direct mechanical connection with said plug end of said attachment fixture such that vibrational forces generated in said tubular outer metal shell portion of said bat are transferred between said tubular hand gripping end and said vibration damping mechanism through said resonating ring.

6. The bat of claim 5, wherein said mass supports are substantially shaped like an arc having an open side and a closed side, each said open side of each support facing the closed side of an adjacent support.

* * * * *

UNITED STATES PATENT AND TRADEMARK OFFICE

CERTIFICATE OF CORRECTION

PATENT NO. : 6,709,352 B1
APPLICATION NO. : 09/990986
DATED : March 23, 2004
INVENTOR(S) : Joel N. Albin It is certified that error appears in the above-identified patent and that said Letters Patent is hereby corrected as shown below:

In Claim 5, Column 8, lines 13, 14, and 19: change “resonating ring” to --resonating ring end--.

Signed and Sealed this

Second Day of June, 2009

JOHN DOLL
*Acting Director of the United States Patent and Trademark Office*